US008539847B1

(12) United States Patent
Sturdivant

(10) Patent No.: US 8,539,847 B1
(45) Date of Patent: Sep. 24, 2013

(54) AUTOMATED FRAGMENT COLLECTION APPARATUS

(75) Inventor: Charles N. Sturdivant, Nashville, TN (US)

(73) Assignee: Franklin Engineering Group, Inc., Franklin, TN (US)

( * ) Notice: Subject to any disclaimer, the term of this patent is extended or adjusted under 35 U.S.C. 154(b) by 657 days.

(21) Appl. No.: 12/632,704

(22) Filed: Dec. 7, 2009

(51) Int. Cl.
*G01N 1/12* (2006.01)

(52) U.S. Cl.
USPC ..... 73/864.51

(58) Field of Classification Search
USPC ..... 73/864.51, 167, 35.17; 102/491, 102/293, 492; 273/373, 408
See application file for complete search history.

(56) References Cited

U.S. PATENT DOCUMENTS

| | | | | |
|---|---|---|---|---|
| 1,897,731 | A | 2/1933 | Manegold | |
| 4,044,599 | A | 8/1977 | Goldstein et al. | |
| 4,334,423 | A * | 6/1982 | Rainis et al. | 73/35.14 |
| 4,901,361 | A | 2/1990 | Glenn et al. | |
| 7,334,466 | B1 | 2/2008 | Brislin | |
| 7,416,008 | B2 * | 8/2008 | Mikkelsen et al. | 156/356 |

OTHER PUBLICATIONS

Zaker, Fragment and Debris Hazards, Jul. 1975, Department of Defense Explosives Safety Board, pp. 3 and 13.*

* cited by examiner

*Primary Examiner* — Peter Macchiarolo
*Assistant Examiner* — Tamiko Bellamy
(74) *Attorney, Agent, or Firm* — Waddey & Patterson, P.C.; Ryan D. Levy

(57) ABSTRACT

An apparatus for collecting fragments from a substrate subjected to an exploded munition, including a predetection element for removing large fragments from a sheet of the substrate; a detection and removal element for locating fragments embedded within the sheet and for removing located fragments from the sheet; and a capture element for capturing removed fragments.

14 Claims, 4 Drawing Sheets

AUTOMATED FRAGMENT COLLECTION APPARATUS

This is a Non-Provisional Patent Application filed for the invention by Charles N. Sturdivant, a citizen of the United States residing at 5120 Pine Hill Road, Nashville, Tenn. 37221, of an "Automated Fragment Collection Apparatus."

BACKGROUND OF THE INVENTION

The present invention relates generally to an apparatus and method for collecting fragments, the fragments being created from the detonation of munitions. In optional embodiments, the system may include a variety of options including the automated removal of captured fragments from sheets so as to provide for a greater ease in the analysis of collected fragments.

A necessary procedure in evaluating the performance of an explosive device includes the characterization and analysis of fragments emitted during detonation of the explosive. One area in which this characterization has become important is in the development of military explosive devices. Typically, the devices are exploded whereby fragments are generated which are projected in a variety of patterns. Often times, such tests are conducted at various Department of Defense and commercial facilities where a series of insulating panels are organized in an arena type arrangement. The emitted fragments resulting from the explosion should be captured for an analysis which creates the complication of maintaining the fragments despite there high initial speed yet not breaking the fragments into smaller pieces as a result of being captured.

The containment of the fragments must be soft enough to avoid creating additional fragments and thus changing the analysis resulting from the explosion. A technique customary in the industry involves the use of sheets of a building substrate, known as Celotex, as the material which is organized into stacks around the explosive device. Commonly commercial available sizes include about 4 ft. by 8 ft. sheets with each Celotex sheet having a thickness of about ½ inch. Generally more around 80 to 120 sheets are stacked together and secured and subsequently oriented with other stacks of Celotex to function as a capturing substrate in creating an arena around the munition to be detonated. Often times, the stacks of Celotex materials may be 2-3 stacks high forming a generally circular shape about the munition.

The munition is then detonated with the stacks of material absorbing fragments from the exploded munition. The stacks of Celotex are then subsequently disassembled and individually inspected so that the location of fragments emitting from the explosion are determined. Typically, each stack is prescribed a specific number with the individual sheets having separate indications so that a user can specifically determine the depth to which a fragment has penetrated a stack and generally in what direction a blast caused the fragments to move.

The analysis of the panels is quite laborious as an individual must measure and locate the mass of each fragment created from the explosion. For example, in U.S. Pat. No. 4,334,423 issued to Ranis et al., a warhead fragmentometer is discussed where panels may be fed through a magnetometer for locating the ferrous materials of an explosion and thus allegedly provide general fragmentation characteristics of the panel. The alleged method includes counting each fragment maintained within a panel and measuring the location of each fragment within the panel so that fragmentation data can be produced for the exploded munition.

In certain situations, probes may be utilized to determine the depth of fragments so that a user may track how far penetration occurred within a bulk of materials. One may also attempt to dig out the various fragments for further study via a manual extraction process. Generally, this may include the use of a tape measure and careful note taking to maintain the precise data necessary for recording the location of the fragments on or within a panel.

What is desired is an automated fragment collection apparatus for reducing the amount of time required in collecting and analyzing fragments from an exploded munition. Indeed a combination of characteristics including a detection and removal element has been found to be advantageous in increasing the rate at which a panel may be analyzed further analysis subsequent detonation of an explosive device. It would be even further desirable to provide a system that automatically couples the location of a fragment from a munition explosion into a container with the fragment for subsequent analysis.

BRIEF SUMMARY OF THE INVENTION

An optional object of the present invention is to provide an apparatus for the automated collection of fragments from a fragmenting munition which may be utilized with a substrate comprised of sheets having been subjected to a fragmenting explosion. Optionally, this system may address one or more disadvantages of the prior art.

Another optional object of the invention is to provide an apparatus for the automated collection of fragments so that the cost associated with the labor required for manual fragment measurement is reduced.

Yet another optional object of the invention is to provide an apparatus for the automated collection of fragments wherein the accuracy of the data collected may be improved over the manual collection process.

In accordance with the purpose of the invention, as embodied and broadly described herein, the invention includes an apparatus for the automated collection of fragments resulting from an explosion. This apparatus may include one or more elements for locating and collecting fragments embedded within sheets. The apparatus may further include a detection element which may optionally first detect whether or not there are any fragments within the sheet and secondly, may detect the location of fragments if there are fragments located within the sheet. The apparatus may further include a removal element which may optionally comprise a moving punch head to remove fragments from the sheet. In further optional embodiments, the system may include one or more conveyors for moving containers to coordinate with the punched fragments.

As used herein, the term "munition" means any explosive device which may produce fragments.

Further, as used herein, the term "engaged" means to interact with, interlock with, associate with, or communicate with.

Yet further as used herein, the term "collect" and various forms thereof mean to acquire, gather, assemble, accumulate, or receive physical fragments or data about physical fragments.

According to another optional aspect of the invention, an apparatus for the automatic collection of fragments may include a combination of a projector with a table so that large fragments may be easily mapped. The system may further include a grid, including an X-Y scale projection, as well as indices on the edges of a table for ease in tracking the location of large fragments which may be then be removed manually. Other optional aspects of the system may include various drives for advancing or reversing the sheet through a metal detection element as well as onto or off of the system.

The apparatus may also include a control unit either integrated into the detection and removal element or situated separately for controlling the progression of each sheath through the apparatus as well as the movement of the punch head.

The apparatus that has been described may be particularly useful for collecting fragments subsequent to an explosion conducted in an arena type arrangement.

Aside from the structural and procedural arrangement set forth above, the invention could include a number of other arrangements, such as those explained hereinafter. It is to be understood, that both the foregoing description and the following description are exemplary.

BRIEF DESCRIPTION OF THE SEVERAL VIEWS OF THE DRAWINGS

The accompanying drawings are incorporated in and constitute a part of the specification. The drawings illustrate optional embodiments of the invention, and together with the description, serve to explain some principles of the invention.

DETAILED DESCRIPTION OF THE INVENTION

Figure 1:
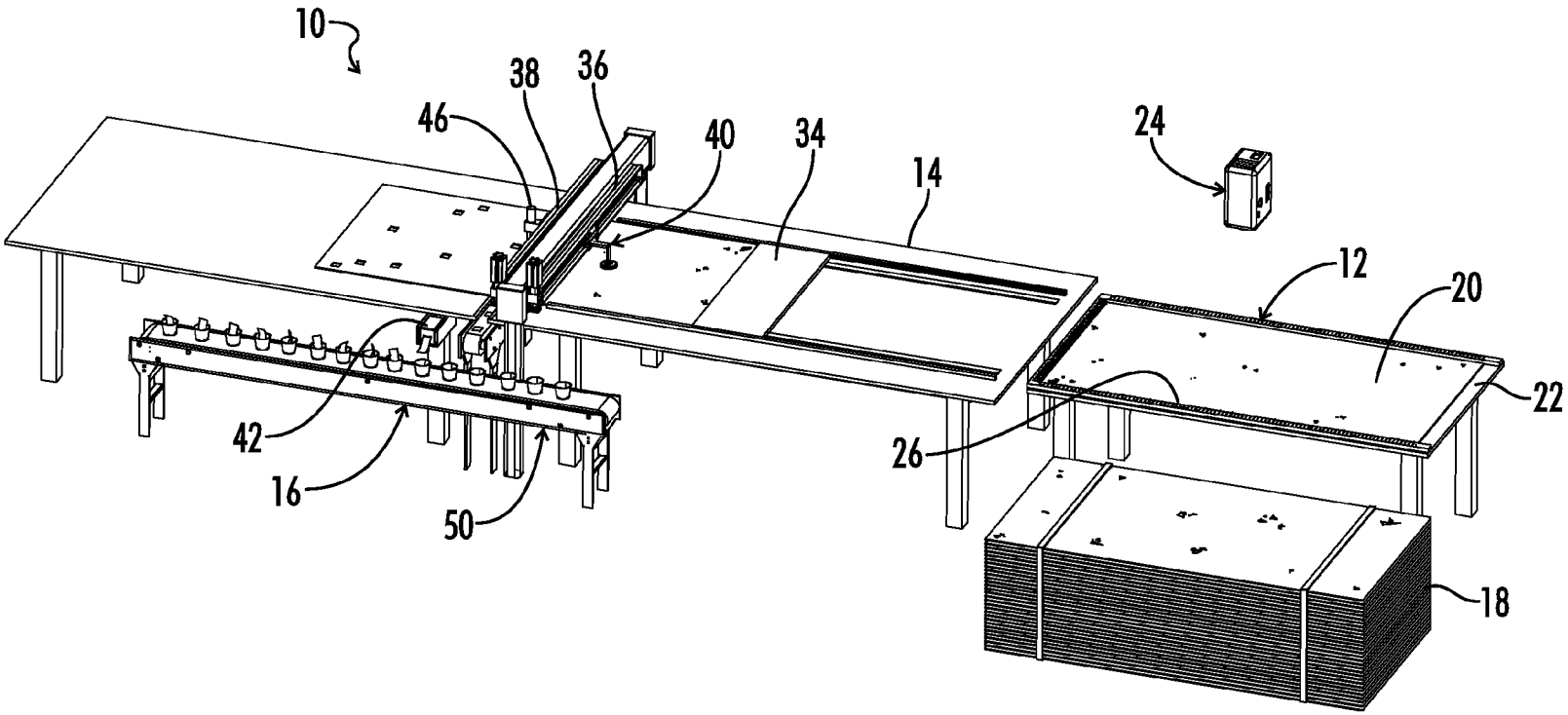
FIG. 1 is a perspective view of an optional embodiment of an apparatus for automated fragment collection.

Reference will now be made in detail to optional embodiments of the invention, examples of which are illustrated in accompanying drawings. Whenever possible, the same reference numbers are used in the drawings and the description refers to the same or like parts.

As shown in FIG. 1, an optional embodiment of the fragment collection apparatus 10 may comprise predetection element 12, detection and removable element 14, and capture element 16. In further embodiments, each of these elements alone may function independently and may be considered optional embodiments of the present invention, and as such not all three elements have to be combined for practice of the present invention. For example, a user may only require predetection element 12 in certain embodiments, whereas in other embodiments, a detection and removable element 14 may only be needed depending on the considerations and requirements of the user. Furthermore, the design and orientation of the various elements in an embodiment of fragment collection apparatus 10 may be decided by the individual using the system, and furthermore necessary elements may be determined upon the size and type of specific substrate for which the system may be designed to function therewith.

Figure 2:
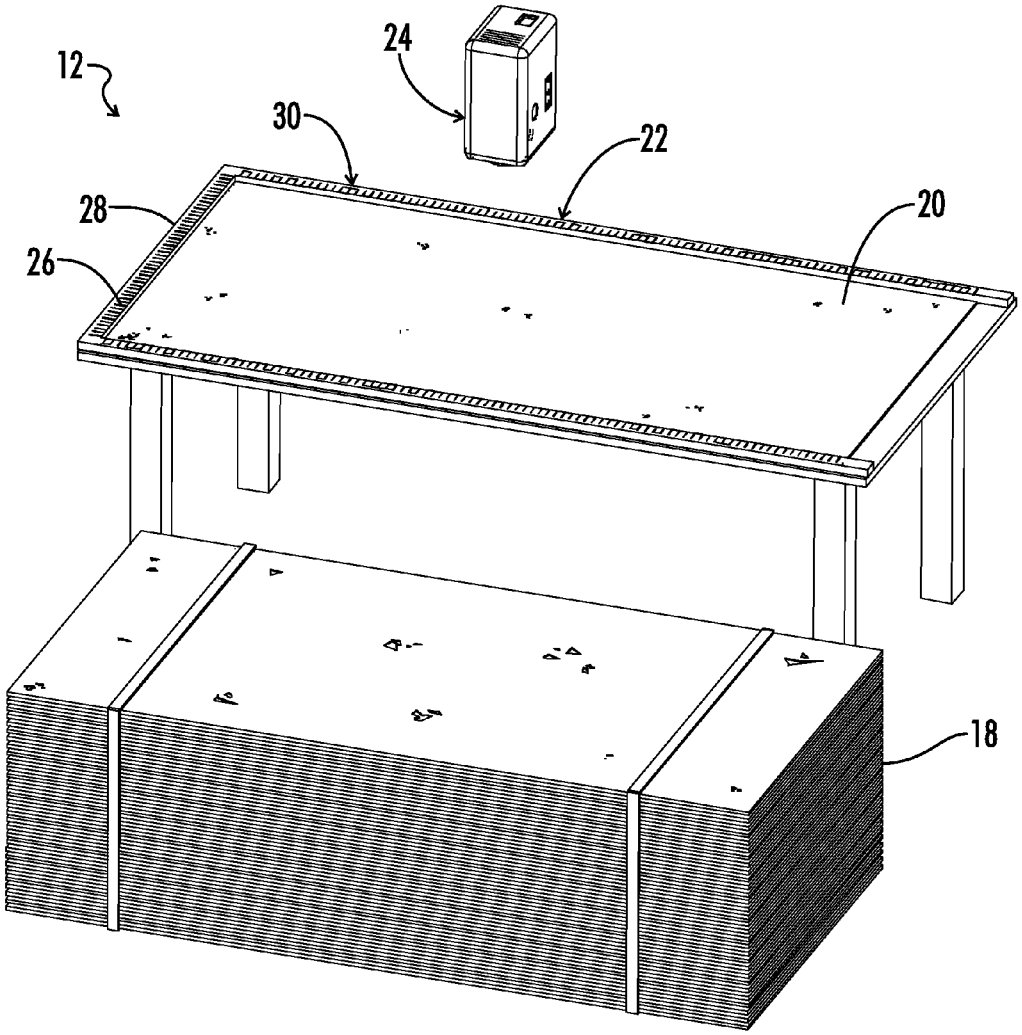
FIG. 2 is a view of an optional embodiment of a predetection element of the apparatus for automated fragment collection.

Referring now to FIG. 2, an optional embodiment of predetection element 12 may comprise table 22 and projector 24 for use with substrate 18 formed of individual sheets 20. Generally sheets 20 of substrate 18 may be placed upon table 22 of predetection element 12 for the manual removal of large fragments resulting from a munition explosion. Projector 24 may in optional embodiments project a grid onto sheet 20 for providing a method of measuring and recording the location of large fragments. In an optional embodiment, projector 24 may project an X and Y numerical axis with a grid so that sheet 24 can be measured regarding the location of large fragments. Further optional embodiments include table 22 having indices 26 that align with the grid and axis projected by projector 24 so that sheets 24 may be repetitively measured relative to the same orientation. For example, an individual sheet 24 may be placed upon the table aligning with first edge 28 and second edge 30 having indices 26 which would be the similar desired position for other sheets 20 of substrate 18 on table 22 for measuring and the optional removal of large fragments.

In further optional embodiments, projector 24 and table 22 may be oriented and designed for different size sheets 20 and as such, provide different measurements and grid arrangements. In additional optional embodiments, projector 24 may be absent with the user either using inscriptions of first edge 28 and second edge 30 for a rough determination and measurement of the location of large fragments, or alternatively may use traditional methods of manual measurements for locating and tracking large fragments embedded on sheet 20.

Figure 3:
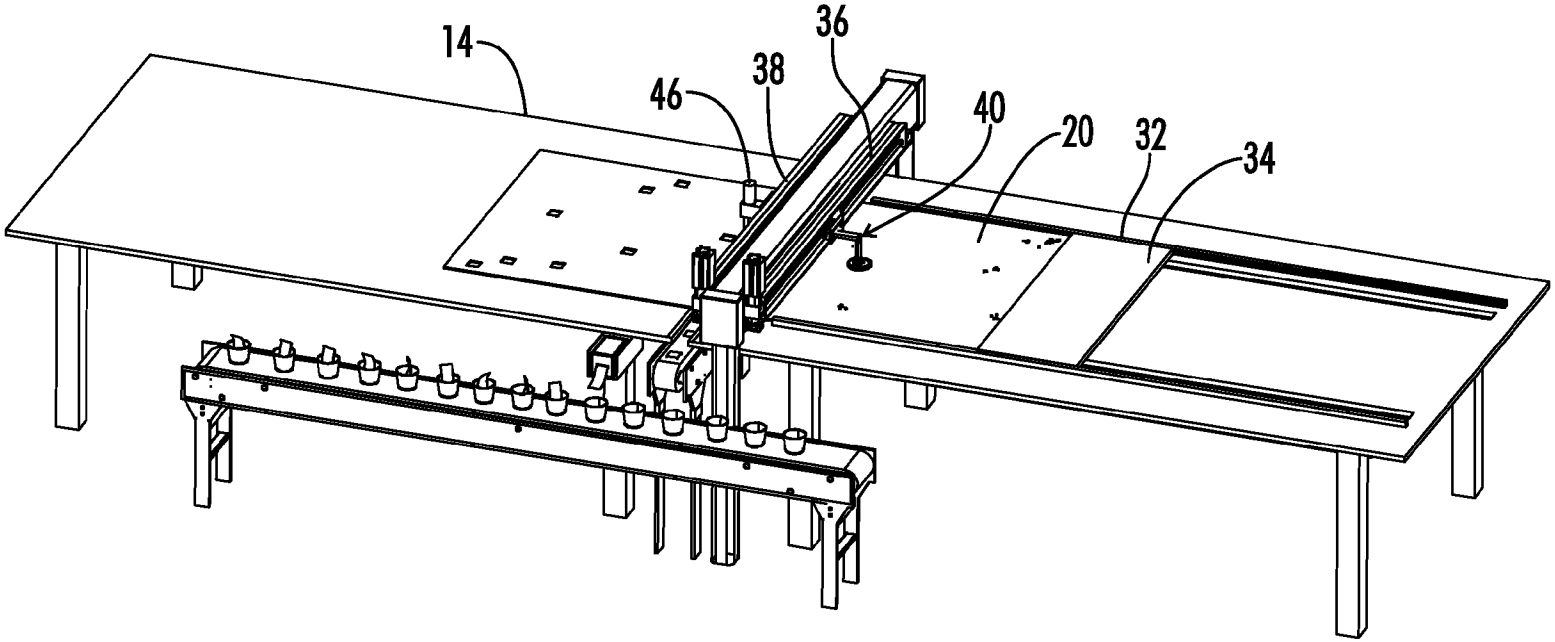
FIG. 3 is a view of the detection and punching element of an optional embodiment of an apparatus for automated fragment collection.

Referring now to FIG. 3, there is an optional embodiment of detection and removal element 14. In optional embodiments, detection and removal element 14 may include a track 32 with drive 34 for advancing a sheet 20 through the element. Drive 34 may comprise a servo-powered drive which may push sheet 20 through detection component 36 and removal component 38. In further optional embodiments not illustrated, track 32 and drive 34 may be absent which would require a user to push sheet 20 manually through detection component 36 and removal component 38. In additional optional embodiments, drive 34 may comprise a variety of different drives known in the art to push sheets used with fragmenting munition.

Detection component 36 may comprise one or more metal detector heads 40 for scanning sheet 20 to determine whether or not any fragments are contained within the sheet. In one optional embodiment, two metal detector heads 40 comprise detection component 36 in scanning and locating fragments within sheet 20. In an optional embodiment, a first metal detector head 40 may scan the entire width of sheet 20 in determination of whether or not any fragments are in that area of sheet 20. In the instance that a fragment is detected, a second metal detection head 40 may traverse the sheet to specifically locate the fragment. In further optional embodiments, one metal head detection 40 may be utilized for detection component 36 though may provide for slower analysis times as opposed to a two metal detection head 40 detection component 36.

The information from the one or more metal detection heads 40 is processed through a control unit either integrated into the detection and removal element 14 or provided separately. As used here, the term control unit may also include controller, unit, controller, control system, computer, or the like. The control unit receives information from the at least one metal detection head 40 and can transfer the location data to the removal component 38 and printer 42. Furthermore, the control system may determine whether or not drive 34 activates and at what speed so as to align sheet 20 under removal component 38 for the removal of fragments. Additionally, the location information may be utilized to change the position of punching head 46 so that specific fragments can be removed at various locations on sheet 20.

Thus, through coordination of drive 34 and a location of one or more metal detection heads 40, the location of the fragment can be located. In optional embodiments, both the heads of detection component 36 and drive 34 may be controlled by control unit embodied as a programmable logic controller (PLC not shown) with the location of the one or more metal detection heads 40 being monitored using feedback from servo resolvers. Detection component 36 may identify and record the location of embedded fragments within sheet 20 through a comparison of the signal strengths generated through scans by one or more metal detector heads 40.

Detection component 36 may in optional embodiments, include the capabilities of outputting the location of a fragment through printer 42, which will be discussed subsequently in reference to capture element 16. As such, a user, through use of detection and removal element 14 can map these specific locations fragments within substrate 18 through analysis of individual sheets 20.

Detection and removal element 14 also includes removal component 38 which can remove located fragments from sheet 20. Generally, the calculated location determine through detection component 36 may be used to active removal component 38 for removing fragments from sheet 20 and thus creating remove fragments 44. In optional embodiments, removal component 38 may comprise a moving pneumatic punch which removes a small section of sheet 20 where a fragment is located. Generally punching head 46 of removal component 38 removes from about 0.5 square inches to about 10 square inches. Further optional embodiments include punching head 46 removing about 1 square inch from sheet 20 for each fragment.

Optional embodiments include punching head 46 being positioned within removal component 38 for removing fragments based upon the location recorded by detection component 36. Punching head 46 may punch against a hardened steel component (not shown) beneath the sheet on detection and removal element 14.

In further optional embodiments, punching head 46 may be powered mechanically, hydraulically, or pneumatically for creating holes within sheet 20. As used herein, "punch" may be understood to mean remove, cutout, segregate or select. In additional optional embodiments, blades, reciprocating elements or other instruments may be used in cutting out fragments instead or, or in addition to, one or more punching heads.

Figure 4:
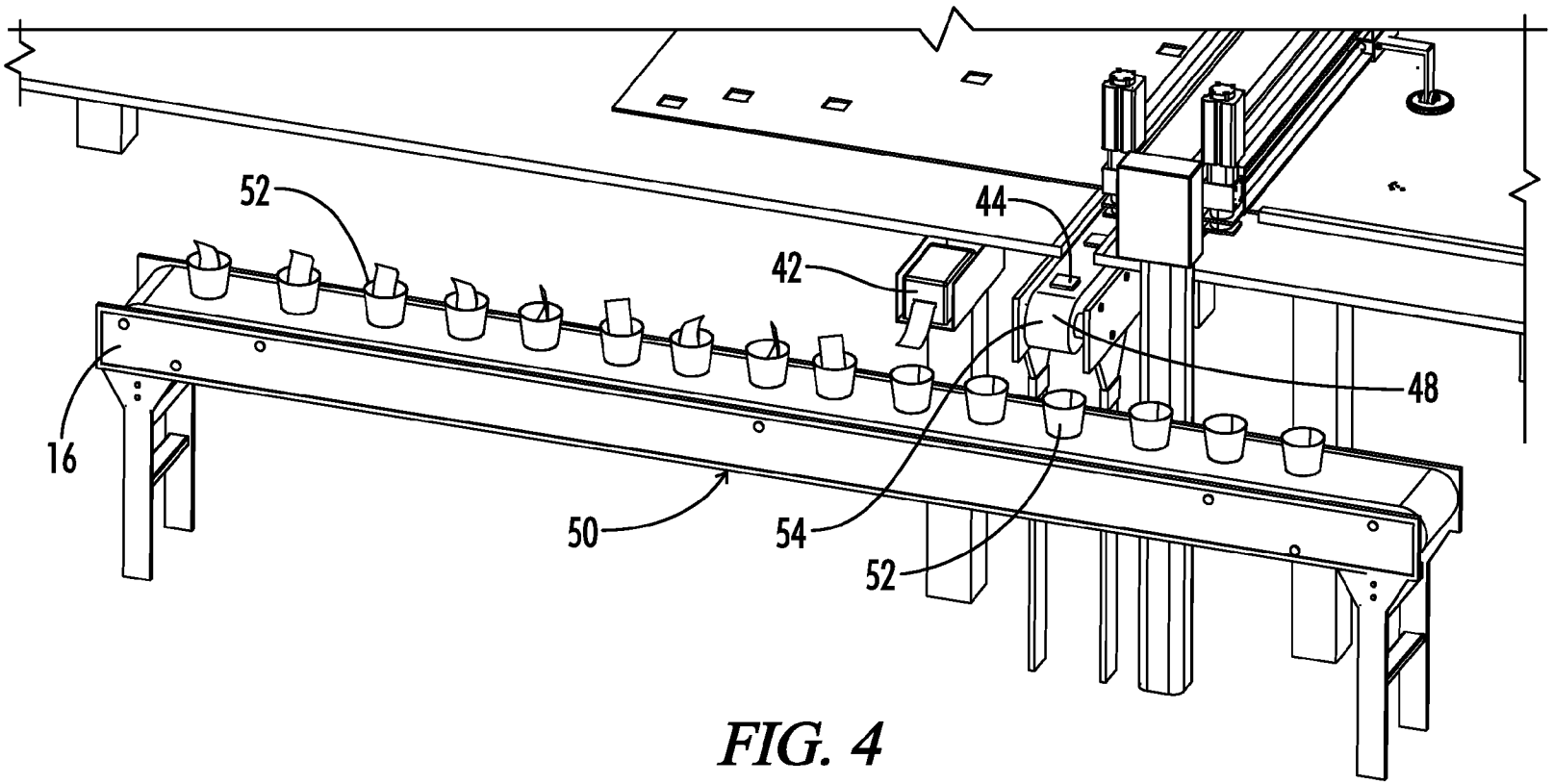
FIG. 4 is a view of an optional embodiment of a capture element of an apparatus for automated fragment collection.

Referring now to FIG. 4, there is capture element 16 which may include cross conveyor 48 and collection conveyor 50. Generally, cross conveyor 48 may be aligned with the location at which punching head 46 punches sheet 20 to create remove fragments 44 whereby removed fragments 44 land upon cross conveyor 48. Otherwise stated, the removed fragments 44 created through punching may fall onto cross conveyor 48. Cross conveyor 48 may then convey removed fragments 44 to collection conveyor 50 for the collection of removed fragments 44 within containers 52. Cross conveyor 48 and collection containers 52 may be oriented so that removed fragments 44 fall into containers 52 set upon collection conveyor 50 for the collection of the fragments. In further optional embodiments, printer 42 may print the location of removed fragment 44 and deposited it into container 52 with removed fragment 44. Detection component 36, in optional embodiments with the control system provides the location to printer 42 which may print the location on a strip of paper which may be automatically deposited into container 52, containing removed fragment 44. Subsequently, collection conveyor 50 may then index to place the next empty container 52 under discharge end 54 of cross conveyor 48. Further optional embodiments provide for printer 42 to generate both the sheet number and location of remove fragments 44 on the strip as well as optionally including a space for the manual entry of the mass of the fragment.

Further optional embodiments may include using one or more metal detector heads to approximate the mass of the fragment based upon the strength of the signal emitted from a fragment embedded within a sheet 20. Such computation may be conducted by the control system within or separate from detection component 36, with the approximate mass also included on the output from printer 42. This may optionally preclude the step of manually weighing each fragment subsequent to the collection within containers 52.

The automated fragment collection apparatus that has been described may be utilized to collect fragments resulting from an exploding munition. Generally the user may first remove and track large fragments through the use of predetection element 12 with projector 24 and table 22. Subsequently, the subject sheet may be removed from table 22 and placed upon detection and removal element 14 wherein drive 34 may progress sheet 20 through both the detection component and the removal component of apparatus 10. Detection component 36, through one or more metal detector heads 40, may locate fragments embedded within sheet 20. The location information may be handled by a control unit and provided to removal component 38 so that punching head 46 may be positioned to remove embedded fragments from sheet 20 allowing such fragments to land upon cross conveyor 48. Removed fragments 44, created through punching, may be conveyed on cross conveyor 48 to discharge end 54 where collection conveyor can indexes container 52 for the capture of remove fragments 44. Additionally, printer 42 uses the location information resulting from detection component 38 to print information for inclusion within container 52 pertaining to the specific removed fragment 44.

Generally, one may be able to utilize the information received from processing the sheets and generate a composite diagram illustrating the locations of all of the fragments in each stack of sheets. Otherwise stated, through the use of the location data, coupled with knowledge of the position of the individual sheets from which the fragments were removed, a method is provided where the information can be utilized to generate a composite diagram of where the fragments became fixed within the arena resulting from the explosion.

In further optional embodiments, dedicated software may be included so as to facilitate the operation of the system. In optional embodiments the software may be utilized with the control system in coordinated the removal of fragments from the sheets. In additional optional embodiments, the software may generate an image or map of the relative locations of the fragments within the substrates forming the arena. A dedicated software system may optionally provide for remote capabilities as well as provide and assist a user in processing the sheets subsequent to an explosion. Additional optional embodiments may include further software features not include and in no way is any discussion of software within this paper preclusive of further optional embodiments.

Sizes of various structure parts and materials used to make the above mentioned part are illustrative and exemplary only, and persons of ordinary skill in the art would recognize that the sizes and materials can be changed as necessary to produce different effects or desired characteristics.

What is claimed is:

1. An apparatus for collecting fragments from a substrate subjected to an exploded munition, comprising:

a predetection element including a table and a projector for removing large fragments from a sheet of the substrate;

a detection and removal element for locating fragments embedded within the sheet and for removing located fragments from the sheet; and a capture element for capturing removed fragments.

2. The apparatus of claim 1 wherein the projector projects a grid and the table further comprises indices corresponding to the grid.

3. The apparatus of claim 1 wherein the detection and removal element comprises a detection component with at least one metal detection head.

4. The apparatus of claim 3 wherein the detection component comprises at least two metal detection heads.

5. The apparatus of claim 1 wherein the detection and removal element comprises a removal component with at least one punching head.

6. The apparatus of claim 5 wherein the detection and removal element further comprises a hardened material opposite the at least one punching head.

7. The apparatus of claim 1 wherein the detection and removal element comprises a detection component with at least one metal detection head and a removal component with at least one punching head.

8. The apparatus of claim 7 further comprising a control unit for coordinated the movement of the punching head for removing a located fragment.

9. The apparatus of claim 7 further comprising a drive for advancing the sheet through the detection component and the removal component.

10. The apparatus of claim 1 wherein the detection and removal element further comprising a printer for outputting the location of located fragments.

11. The apparatus of claim 1 wherein the capture element comprises a cross conveyer and a collection conveyor.

12. An apparatus for collecting fragments from a substrate subjected to an exploded munition, comprising:

a detection component with at least one metal detection head for locating fragments embedded within a sheet of the substrate;

a removal component with at least one punching head for removing fragments embedded within the sheet; and a drive for advancing the sheet through the detection component and removal component.

13. The apparatus of claim 12 further comprising a capture element having a cross conveyor and a collection conveyor.

14. The apparatus of claim 12 further comprising a predetection element with a table and a projector.

* * * * *